US010819055B2

(12) United States Patent
Takeuchi et al.

(10) Patent No.: US 10,819,055 B2
(45) Date of Patent: Oct. 27, 2020

(54) CONNECTOR AND METHOD FOR MANUFACTURING ELECTRICAL CONNECTION ASSEMBLY PROVIDED WITH SAME

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shunya Takeuchi, Mie (JP); Yasuo Omori, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/482,414

(22) PCT Filed: Jan. 16, 2018

(86) PCT No.: PCT/JP2018/000931
§ 371 (c)(1),
(2) Date: Jul. 31, 2019

(87) PCT Pub. No.: WO2018/142912
PCT Pub. Date: Aug. 9, 2018

(65) Prior Publication Data

US 2020/0014138 A1 Jan. 9, 2020

(30) Foreign Application Priority Data

Feb. 2, 2017 (JP) ..... 2017-017815

(51) Int. Cl.
*H01R 13/05* (2006.01)
*H01R 4/02* (2006.01)
(Continued)

(52) U.S. Cl.
CPC ..... *H01R 13/055* (2013.01); *H01R 4/024* (2013.01); *H01R 13/629* (2013.01); *H01R 43/02* (2013.01)

(58) Field of Classification Search
CPC .... H01R 43/0207; H01R 43/24; H01R 4/029; H01R 13/658; H01R 3/36
See application file for complete search history.

(56) References Cited

U.S. PATENT DOCUMENTS 6,027,009 A 2/2000 Shinchi
6,167,616 B1 1/2001 Shinchi
(Continued)

FOREIGN PATENT DOCUMENTS

JP 5-206627 8/1993
JP 11-8037 1/1999
(Continued)

OTHER PUBLICATIONS

International Search Report dated Apr. 3, 2018.

*Primary Examiner* — Xuong M Chung Trans
(74) *Attorney, Agent, or Firm* — Gerald E. Hespos; Michael J. Porco; Matthew T. Hespos

(57) ABSTRACT

A connector of an electrical connection assembly includes terminals (20) corresponding respectively to wires (10) arranged in a wire arrangement direction, an insulating housing and connecting members (70) applied to the terminals (20). Each terminal (20) has a wire connection surface (27*a*). The connecting member (70) is made of solder and is fixed to the wire connection surface (27*a*) to electrically connect a conductor (12) of the wire (10) and the wire
(Continued)

connection surface (27*a*). A surface of the connecting member (70) has a convex-concave shape including restricting portions (73, 74) for restricting displacement of the wire (10) with respect to the wire connection surface (27*a*) in the wire arrangement direction, thereby ensuring high connection reliability by stabilizing relative positions of the wires and terminals in the connector.

5 Claims, 12 Drawing Sheets

(51) Int. Cl.
*H01R 13/629* (2006.01)
*H01R 43/02* (2006.01)

(56) References Cited

U.S. PATENT DOCUMENTS

| | | | | |
|---|---|---|---|---|
| 9,276,330 | B2 * | 3/2016 | Wu | H01R 12/775 |
| 10,312,609 | B2 * | 6/2019 | Kawate | H01R 12/585 |
| 10,566,705 | B2 * | 2/2020 | Washio | H01R 13/516 |
| 2011/0034084 | A1 | 2/2011 | Hsueh et al. | |

FOREIGN PATENT DOCUMENTS

| | | |
|---|---|---|
| JP | 11-45744 | 2/1999 |
| JP | 2006-228668 | 8/2006 |
| JP | 2010-146939 | 7/2010 |
| JP | 4681910 | 11/2011 |

* cited by examiner

CONNECTOR AND METHOD FOR MANUFACTURING ELECTRICAL CONNECTION ASSEMBLY PROVIDED WITH SAME

BACKGROUND

Field of the Invention

The invention relates to a connector constituting an electrical connection assembly used in an automotive vehicle or the like and a method for manufacturing such an electrical connection assembly.

Related Art

A known wiring member used in an automotive vehicle or the like has a flat shape with wires arranged in a direction orthogonal to an axial direction of the wires. The wires can be connected to terminals of a connector that includes the terminals and a housing.

Japanese Unexamined Patent Publication No. 2010-146939 discloses a connector and an assembly in which connection to wires of the above-described wiring member is made by soldering. The connector described in includes terminals in the form of thin plates respectively corresponding to the wires and a housing for holding the terminals. The housing has a flat terminal arrangement surface and the terminals are held in such a manner as to be exposed on the terminal arrangement surface. On the other hand, an insulation coating is removed in advance on an end of each of the wires to expose a conductor, and the wires are held at a position near tips of the conductors so that the tips of the conductors are aligned in a row.

In the above connector, cream solder is set in advance on surfaces of the terminals, and the tips of the conductors and the surfaces of the terminals are soldered by pressing the tips of the conductors against the surfaces of the terminals by a heater with the tips of the conductors positioned on the cream solder and heating the cream solder.

In the manufacturing of the assembly as described above, end parts of the wires where the conductors are exposed are placed on the surfaces of the terminals and are soldered while the wires are held collectively. Thus, a relative position of the end of each wire with respect to each terminal is unstable. As just described, the soldered position of each wire end to the corresponding terminal is unstable and hinders an improvement of connection reliability. This problem becomes more serious as the wires become thinner and the terminals become smaller.

An object of the invention is to provide a connector, an electrical connection assembly with a plurality of wires and the connector and a method for manufacturing an electrical connection assembly. More particularly, the object is to ensure that the connector and the method achieve high connection reliability by stabilizing relative positions of the wires and terminals included in the connector.

SUMMARY

One aspect of the invention relates to a connector of an electrical connection assembly that includes wires, each of which has a conductor. The connector includes terminals respectively corresponding to the wires. Connecting members formed of solder and are applied respectively to the terminals, and an insulating housing collectively holds the terminals arranged in a wire arrangement direction such that the wires are conductively connectable to the terminals respectively via the connecting members while being arranged at intervals in the wire arrangement direction orthogonal to a longitudinal direction of the wires. Each of the terminals includes an outward projection projecting farther out than a surface of the insulating housing. The outward projection has a wire connection surface connectable to the conductor of the wire at a position separated out from the surface of the insulating housing, and the connecting member is fixed on the wire connection surface. A surface of the connecting member fixed on the wire connection surface of at least some of the terminals has a convex-concave shape including restrictions located on both sides of the wire in the wire arrangement direction and configured to restrict displacement of the wire with respect to the wire connection surface in the wire arrangement direction.

The restrictions formed on the surface of the connecting member formed of solder, as described above, can stabilize the relative position of the wire with respect to the connecting member and the wire connection surface having the connecting member fixed thereto by being located on the both sides of the wire and restraining the wire in the wire arrangement direction. By melting the connecting members in this state, the conductors of the wires and the wire connection surfaces can be connected via the connecting members, and the electrical connection assembly having high connection reliability can be obtained by solidifying the connecting members thereafter. That is, the wires can be positioned with respect to the wire connection surfaces in the wire arrangement direction, utilizing the connecting members for connecting the wire connection surfaces of the terminals and the conductors of the wires corresponding to the wire connection surfaces.

The shape of the surface of the connecting member includes a recess shaped to restrict a displacement of the wire in the wire arrangement direction by receiving the corresponding wire fit therein and an inner side surface of the recess constitutes the restricting portions. This recess can stabilize the relative position of the wire in the wire arrangement direction with respect to the connecting member and the wire connection surface having the connecting member fixed thereto by receiving the wire fit therein.

The recess may be a groove extending parallel to the longitudinal direction of the wire. The groove can stabilize the position of the wire in the wire arrangement direction with respect to the wire connection surface having the connecting member fixed thereto, and can stabilize the posture of the wire (extending direction of the wire) on the wire connection surface.

The groove may include two positioning inclined surfaces inclined toward each other in a direction parallel to the wire arrangement direction toward a bottom part of the groove as the restricting portions. The positioning inclined surfaces can reliably contact the wire fit into the groove between the positioning inclined surfaces and reliably position the wire with respect to the wire connection surface by this contact.

Further, a method is provided for manufacturing an electrical connection assembly with wires and the connector according to the present invention. This method includes a connector preparing step of preparing the connector, and a connecting step of electrically connecting a part to be connected set in each of the wires and the wire connection surface corresponding to this part to be connected with the of wires arranged at intervals in the wire arrangement direction. The connecting step includes determining a relative position of the wire with respect to the wire connection surface having the connecting member fixed thereto by engaging the connecting member and the wire such that a relative displacement in the wire arrangement direction of the part to be connected of the wire corresponding to the connecting member including the restricting portions out of the connecting members is restricted by the restricting portions, and electrically connecting the part to be connected and the wire connection surface via the connecting member by heating and melting the solder constituting the connecting member in the engaged state.

According to this method, the relative position of the part to be connected with respect to the wire connection surface of the terminal having the connecting member fixed thereto can be stabilized by engaging the connecting member including the restricting portions and the part to be connected of the wire and, in addition, the part to be connected and the wire connection surface can be efficiently electrically connected via the connecting member by heating and melting the solder constituting the connecting member in that state.

The connector preparing step may include fixing the connecting member to each of the wire connection surfaces of the terminals, holding the terminals in the insulating housing, and forming the restricting portions on the surface of the connecting member by plastically deforming the connecting member fixed to the wire connection surface of at least some of the plurality of terminals. In this method, the restricting portions having a preferable shape easily can be formed by the plastic deformation of the connecting member, utilizing a property of the solder constituting the connecting member.

The restricting portions may be formed after the terminals are held in the insulating housing. By forming the restricting portions with the terminals positioned with respect to the insulating housing and with respect to each other by holding the terminals by the insulating housing, accuracy not only in positioning the wire with respect to the wire connection surface of the terminal having the connecting member with the restricting portions fixed thereto, but also in positioning the wires with respect to the insulating housing and positioning the plurality of wires with respect to each other can be enhanced.

DETAILED DESCRIPTION

FIGS. 1 to 16 show an electrical connection assembly and a manufacturing method therefor according to the embodiment of the invention. The electrical connection assembly includes wires 10 and a connector CN for connecting the plurality of wires 10 to another connector.

Figure 10:
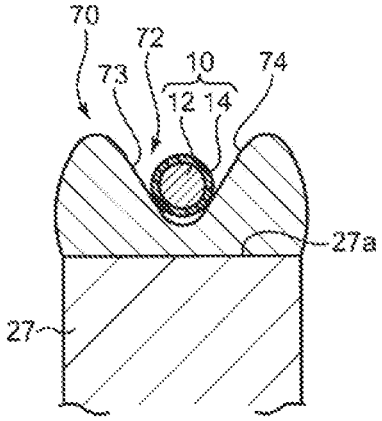
FIG. 10 is a front view in section showing the state of FIG. 9.
Figure 13:
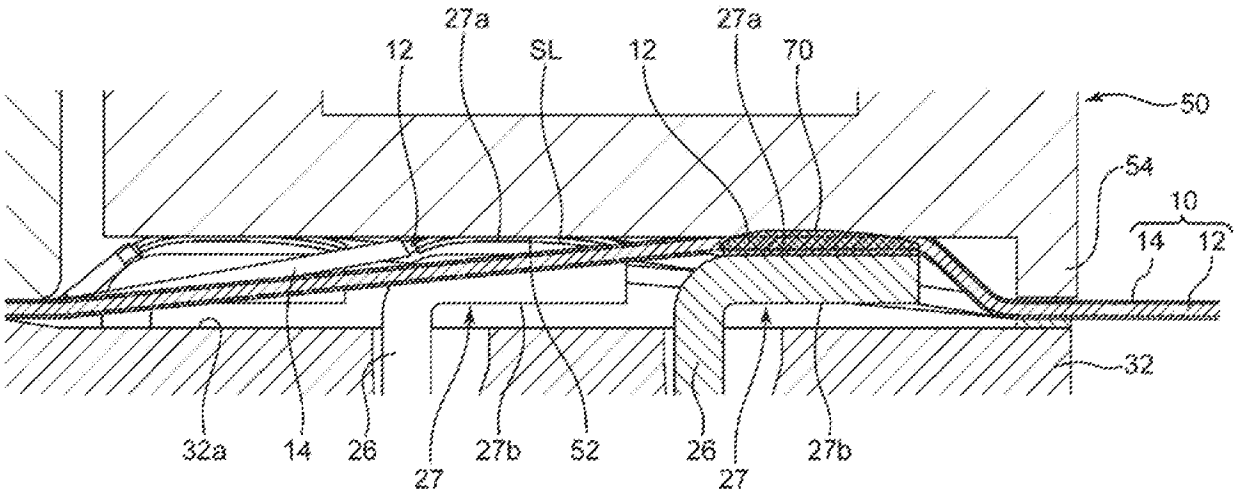
FIG. 13 is an enlarged view of an area enclosed by a frame line XIII in FIG. 12.

Each of the wires 10 includes a conductor 12 and an insulation coating 14 covering the conductor 12, as shown in FIGS. 10 and 13. The wires 10 are connected to the connector CN while being arranged in parallel to each other at intervals in a wire arrangement direction orthogonal to a longitudinal direction of the wires 10. The wires used in the invention may be bare wires without the insulation coatings 14. Alternatively, insulation coatings of wires adjacent to each other may be connected integrally to each other via thin plate parts, thereby constituting a ribbon wire.

The connector CN includes terminals 20 respectively corresponding to the wires 10, an insulating housing 30 for collectively holding the terminals 20 and connecting members 70 respectively made of solder and applied respectively to the terminals 20.

Figure 4:
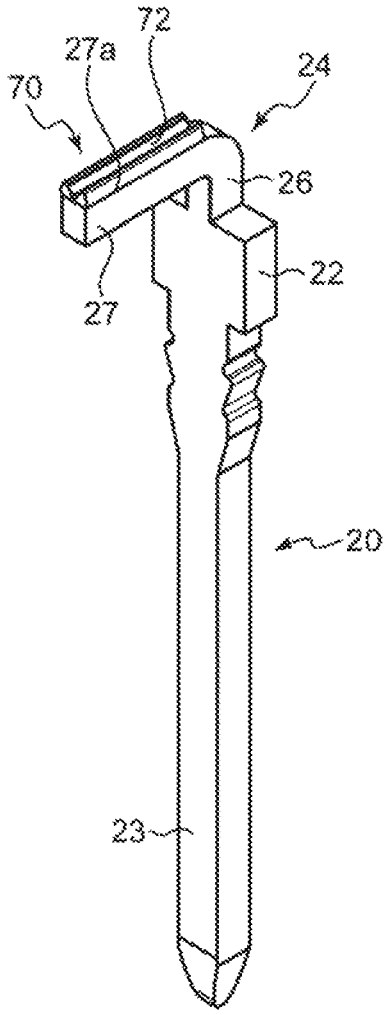
FIG. 4 is a perspective view showing a terminal constituting the connector and a connecting member fixed to a wire connection surface of the terminal.

Each of the terminals 20 of this embodiment is a male terminal constituted by a single long metal plate and includes a held portion 22, an electrical contact 23 and an outward projection 24, as shown in FIG. 4. The held portion 22 is to be held in the insulating housing 30 as described later. The electrical contact 23 is a male contact portion in this embodiment and is shaped to fit to a female contact portion of a mating terminal. Specifically, the electrical contact 23 is shaped to extend straight in a first direction to be described later from the held portion 22. The outward projection 24 projects from the held portion 22 toward a side opposite to the electrical contact portion 23 and to be connected to a corresponding one of the wires 10. The outward projection 24 is described in detail later.

The insulating housing 30 is molded of an insulating material, such as synthetic resin, and integrally includes a terminal holding portion 32, a receptacle 33 and a wire holding portion 34.

The terminal holding portion 32 holds the held portion 22 of each of the terminals 20 and has a block shape in this embodiment. This terminal holding portion 32 arranges the terminals 20 in the wire arrangement direction so that the wires 10 can be connected conductively to the respective outward projecting portions 24 of the terminals 20 while being arranged at intervals in the wire arrangement direction.

Specifically, the terminal holding portion 32 holds the held portions 22 of the terminals 20 in a state where the respective terminals 20 penetrate through the terminal holding portion 32 in a direction parallel to the first direction. The first direction is orthogonal to both the longitudinal direction of the wires 10 and the wire arrangement direction with the wires 10 connected to the terminals 20, and is an upward direction in an orientation shown in FIG. 12. That is, in the orientation shown in FIG. 12, parts of the terminals 20 including the held portions 22 penetrate through the terminal holding portion 32 in a vertical direction. The held portions 22 may be fixed to the terminal holding portion 32 by being press-fit into through holes in the terminal holding portion 32 or may be fixed using an adhesive or the like.

The electrical contact portion 23 of each terminal 20 extends from the held portion 22 in a direction (down in FIG. 12) opposite to the first direction with the held portion 22 held in the terminal holding portion 32, as described above, and is fit into the female contact portion of the mating terminal in this direction. The receptacle 33 is connected integrally to the terminal holding portion 32 and has a tubular shape to surround the electrical contact portions 23 on an outer side in a direction orthogonal to an axial direction (vertical in FIG. 12) of the electrical contact portions 23.

Figure 5:
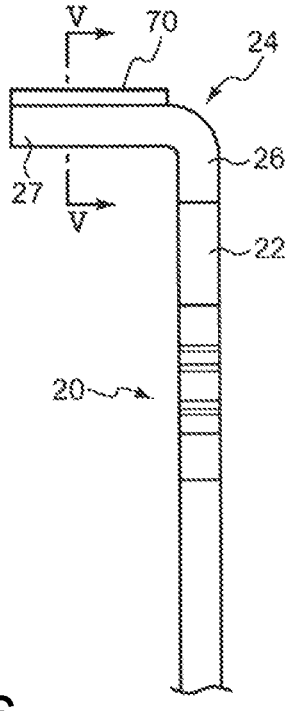
FIG. 5 is a side view of the terminal and the connecting member shown in FIG. 4.

The outward projection 24 of each terminal 20 integrally includes a first projecting portion 26 and a second projecting portion 27 as shown in FIGS. 4, 5 and 13. The first projecting portion 26 projects in the first direction (up in FIG. 13) from a surface (upper surface 32*a* in FIG. 13) of the terminal holding portion 32. The second projecting portion 27 extends from the upper end of the first projecting portion 26 in a second direction (parallel to the upper surface 32*a* in this embodiment; lateral direction in FIG. 13) closer to a direction parallel to the surface of the terminal holding portion 32 than the first direction and orthogonal to the wire arrangement direction.

An outer side surface of the second projecting portion 27 (upper surface in FIG. 13) is opposite to the upper surface 32*a* in FIG. 13 of the terminal holding portion 32 and constitutes a wire connection surface 27*a*. The wire connection surface 27*a* is to be connected electrically to a specific part of the conductor 12 of the wire 10, by soldering (i.e. using the connecting member 70 as a connecting medium) with the part to be connected placed on the wire connection surface 27*a* via the connecting member 70. The wire connection surface 27*a* according to this embodiment extends parallel to the upper surface 32*a* of the terminal holding portion 32.

The connecting members 70 are fixed respectively to the wire connection surfaces 27*a* of the terminals 20. The connecting member 70 has a cross-sectional shape to bulge up from the wire connection surface 27*a* and is set on the wire connection surface 27*a* to extend along the longitudinal direction of the wire 10.

Figure 6:
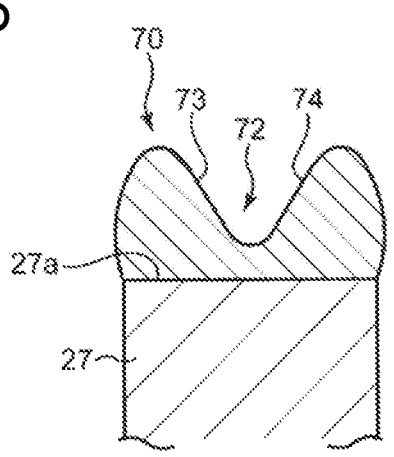
FIG. 6 is a front view in section along VI-VI of FIG. 5.

Further, a surface of the connecting member 70 is formed into a convex-concave shape to include a recessed groove 72, as shown in FIG. 6. This groove 72 is a recess extending in the longitudinal direction of the wire 10, and is shaped to restrict a relative displacement of the wire 10 in the wire arrangement direction (width direction of the terminal 20; lateral direction in FIG. 10) by receiving the wire 10 therein, as shown in FIG. 10.

As shown in FIG. 6, each groove 72 has two positioning inclined surfaces 73, 74 that are inclined toward each other in a direction parallel to the wire arrangement direction toward a bottom part of the groove 72. The positioning inclined surfaces 73, 74 portions are located at both sides of the wire 10 in the wire arrangement direction and are configured to restrict a relative displacement of the wire 10 with respect to the wire connection surface 27*a* in the wire arrangement direction.

A projecting dimension of the first projecting portion 26 in the first direction from the upper surface 32*a* of the terminal holding portion 32 is set set to position the second projecting portion 27 such that the second projecting portion 27 extends in the second direction at a position where a surface of the second projecting portion 27 facing the upper surface 32*a* of the terminal holding portion 32, i.e. an inner side surface (lower surface in FIG. 13) opposite to the wire connection surface 27*a* is separated outward (up in FIG. 13) from the upper surface of the terminal holding portion 32. This projecting dimension is equal for all the terminals 20. Accordingly, the terminal holding portion 32 holds the terminals 20 such that the wire connection surfaces 27*a* of the respective terminals 20 are arranged on the same plane. Alternatively, a specific height difference may be given between the wire connection surfaces 27*a*.

The terminals 20 can also be arranged freely. The terminal holding portion 32 in this embodiment holds the held portions 22 of the terminals 20 such that the wire connection surfaces 27*a* of the terminals 20 are arranged at intervals in the wire arrangement direction. In addition, the wire connection surfaces 27*a* of the terminals 20 that are adjacent in the wire arrangement direction are displaced from each other in the longitudinal direction (vertical direction of FIG. 2) of the wires 10. Specifically, in the arrangement shown in FIG. 2, the outward projections 24 having the wire connection surfaces 27*a* are arranged along three rows in a direction parallel to the longitudinal direction of the wires 10 and the positions of the wire connection surfaces 27*a* of the outward projections 24 arranged in each row are displaced from the positions of the wire connection surfaces 27*a* of the outward projections 24 in the row(s) adjacent to this row in the wire arrangement direction.

The wire holding portion 34 extends along a direction parallel to the second direction from the terminal holding portion 32 and holds each of the wires 10 in such a posture that the wires 10 extend along the second direction. The wire holding portion 34 includes parallel wire holding grooves 34*a* respectively corresponding to the wires 10 and supports the wires 10 from below with the respective wires 10 fit in the wire holding grooves 34*a*.

Figure 16:
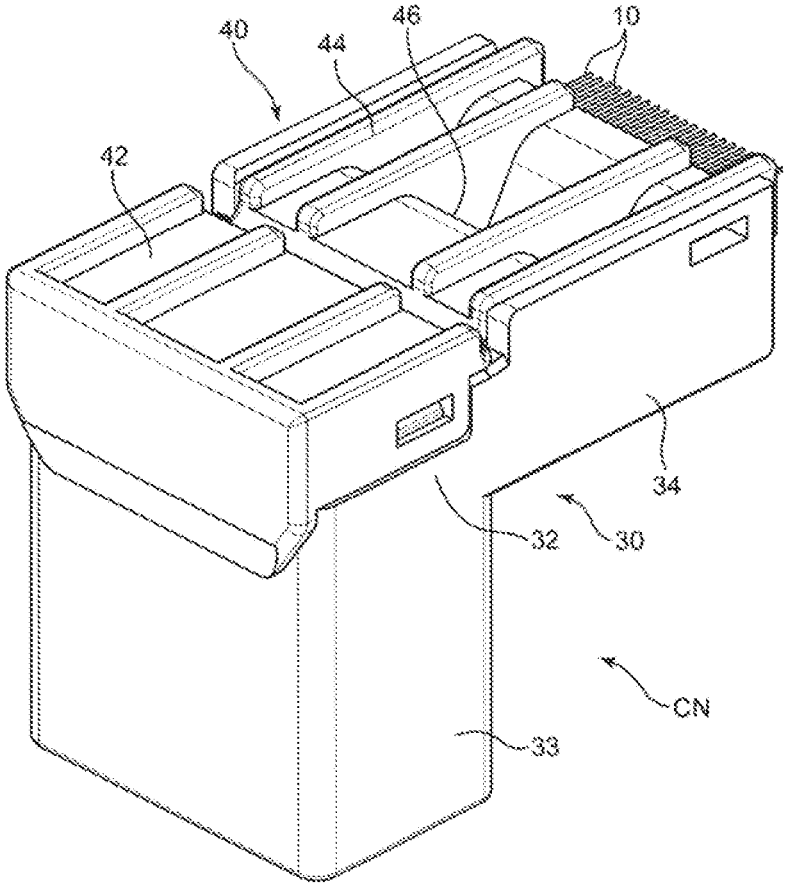
FIG. 16 is a perspective view showing a state where a cover is mounted on an insulating housing of the connector.

The connector CN further includes a cover 40, as shown in FIG. 16. The cover 40 is mounted detachably on the insulating housing 30 to cover the outward projections 24 of the terminals 20 and the respective wires 10 connected to the outward projections 24 from above. Specifically, the cover 40 according to this embodiment integrally includes a terminal cover portion 42 for covering the terminal holding portion 32 and a wire cover portion 44 for covering the wire holding portion 34.

The wire holding portion 34 includes a curved portion 36 in which the upper surface of the wire holding portion 34, i.e. a surface formed with the wire holding grooves 34*a*, is curved to be recessed down at an intermediate position in the second direction. On the other hand, the lower surface of the wire cover portion 44 of the cover 40 includes a curved portion 46 bulging down to correspond to the curved portion 36. The curved portions 46, 36 are shaped to be able to restrain intermediate parts of the wires 10 with the intermediate parts curved downward, thereby effectively suppressing the action of tensile forces of the wires 10 at connected positions of the parts to be connected of the conductors 12 of the respective wires 10 and the wire connection surfaces 27*a*.

The wire holding portion 34 and the cover 40 are not essential in the present invention and can be omitted. Conversely, if the parts of the conductors 12 of the respective wires 10 that are to be connected are in longitudinal intermediate parts of the wires 10 rather than the ends, than the wire holding portions 34 and the wire cover portions 44 of the cover 40 corresponding to the wire holding portions 34 may be provided on both sides of the terminal holding portion 32 in the longitudinal direction of the wires 10.

Next, a method for manufacturing the electrical connection assembly is described. This electrical connection assembly can be manufactured, for example, by a method including 1) a wire preparing step, 2) a connector preparing step, 3) a connecting step and 4) a cutting step, as described next.

1) Wire Preparing Step

The wires 10 described above are prepared in advance. In this embodiment, the insulation coating 14 of the wires 10 is made of a specific synthetic resin that is meltable or decomposable at a melting temperature (e.g. 380 to 400° C.) of the solder constituting the connecting members 70, while having an insulating property at ordinary temperatures. Polyurethane, polyester, nylon and the like are suitable as the specific synthetic resin. A thickness of the insulation coating 14 is set such that the insulation coating 14 can be removed to expose the conductor 12 by heating while an insulated state is ensured at ordinary temperatures. A dimension approximate to a thickness of an insulation coating in an ordinal enamel wire can be applied as this thickness.

2) Connector Preparing Step

The connector CN is prepared by a connector preparing step that includes 2-1) a connecting member applying step, 2-2) a terminal setting step and 2-3) a recessed groove forming step.

2-1) Connecting Member Applying Step

Figure 7:
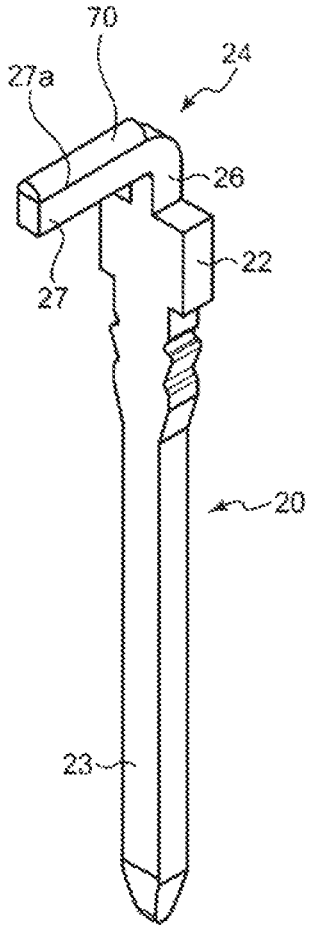
FIG. 7 is a perspective view showing a state before a recessed groove is formed in the connecting member.
Figure 8:
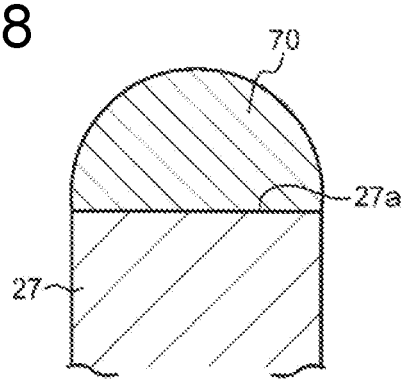
FIG. 8 is a front view in section showing the state of FIG. 7.
Figure 9:
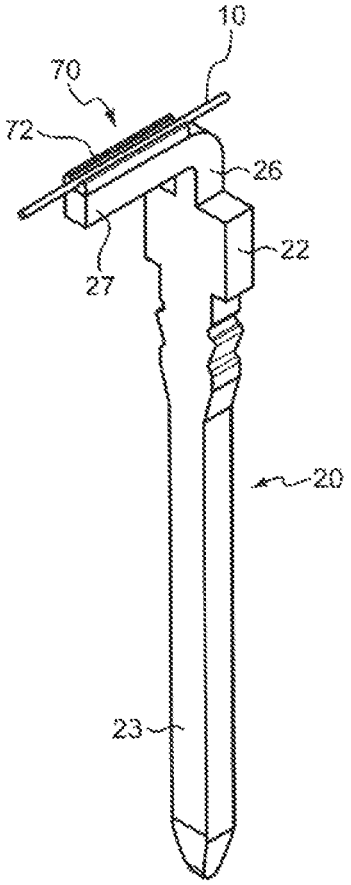
FIG. 9 is a perspective view showing a state where a part to be connected of a wire is fit in the recessed groove formed in the connecting member.

The connecting member 70 is fixed to the wire connection surface 27*a* of each of the terminals 20 of the connector CN. The shape of the connecting member 70 in this stage can be set freely. Generally, the connecting member 70 is fixed to the wire connection surface 27*a* to have a cross-sectional shape so that a central part of the wire connection surface 27*a* in a width direction (direction parallel to the wire arrangement direction) is raised, as shown in FIGS. 7 and 8. The connecting member 70 may be applied to the terminal 20 by fixing the solder of the connecting member 70 and kept in a solid state to the wire connection surface 27*a* or by applying paste solder (connecting member 70) to the wire connection surface 27*a*.

2-2) Terminal Setting Step

This step fixes the terminals 20 in the insulating housing 30, i.e. a step of holding the terminals 20 in the insulating housing 30. Specifically, the terminals 20 are fixed respectively at predetermined positions of the terminal holding portion 32 by inserting and press-fitting the terminals 20 from above into through holes formed in advance in the terminal holding portion 32 of the insulating housing 30 (i.e. by causing the held portions 22 to bite into inner peripheral surfaces of the terminal holding portion 32 enclosing the through holes) or by fixing the held portions 22 to the terminal holding portion 32 by another means such as an adhesive.

The terminal setting step may be performed before the connecting member applying step. That is, the connecting members 70 may be applied with the terminals 20 held in the insulating housing 30. However, if the connecting members 70 are applied by being heated (heating at a temperature beyond the melting point of the solder), the insulating housing 30 is required to have heat resistance sufficient to withstand the heating with the terminals 20 already held in the insulating housing 30, and the material of the insulating housing 30 is limited by that much. Accordingly, it is more preferable that the connecting member applying step is performed before the terminal setting step, i.e. the connecting members 70 are applied to the terminals 20 before the terminals 20 are set in the insulating housing 30.

2-3) Recessed Groove Forming Step

This is a step of forming each connecting member 70 in a state shown in FIG. 8 into a shape as shown in FIG. 10 by plastically deforming each connecting member 70, i.e. a step of forming the groove 72 of each connecting member 70. Each connecting member 70 made of solder as described above easily can be deformed plastically by pressing a mold shaped to correspond to the groove 72 (V-shaped in this embodiment) against the connecting member 70. In other words, the shape of the groove 72 can be set freely by selecting the shape of the mold.

This groove forming step may be performed before or simultaneously with the terminal setting step or the connecting member applying step. For example, the grooves 72 may be formed before the terminals 20 are held in the insulating housing 30, after the connecting members 70 are applied to the respective terminals 20, or the connecting members 70 already formed with the grooves 72 may be fixed to the wire connection surfaces 27*a* of the terminals 20. However, to perform the recessed groove forming step after the connecting member applying step and the terminal setting step, i.e. to form the grooves 72 with the terminals 20 positioned with respect to the insulating housing 30 and with respect to each other by holding the terminals 20 by the insulating housing 30, is advantageous not only in positioning the respective terminals 20 and the wires 10 corresponding to the terminals 20, but also in enabling the positioning accuracy of the respective wires 10 with respect to the insulating housing 30 and the positioning accuracy of the wires 10 with respect to each other to be enhanced. In the latter case, the respective recessed grooves 27 can be formed collectively and efficiently, for example, by pressing a mold integrally including molds respectively corresponding to the terminals 20 against the respective connecting members 70.

The recessed groove forming step may be performed for all the terminals 20 included in the connector CN or may be performed only for some of the terminals 20. That is, the grooves 72 may be formed only in some of the connecting members 70. For example, the recessed grooves may be formed only in the connecting members having a small width required to have particularly high positioning accuracy if widths of the wire connection surfaces of the plurality of terminals and the connecting members to be fixed to the wire connection surfaces differ depending on the terminals.

3) Connecting Step

The terminal setting step may be performed before the connecting member applying step. That is, the connecting members 70 may be applied with the terminals 20 held in the insulating housing 30. However, if the connecting members 70 are applied by being heated (heating at a temperature beyond the melting point of the solder), the insulating housing 30 is required to have heat resistance sufficient to withstand the heating with the terminals 20 already held in the insulating housing 30, and the material of the insulating housing 30 is limited by that much. Accordingly, it is more preferable that the connecting member applying step is performed before the terminal setting step, i.e. the connecting members 70 are applied to the terminals 20 before the terminals 20 are set in the insulating housing 30.

3-1) Wire Engaging Step

This step restricts displacements of the wires 10 with respect to the connecting members 70 in the wire arrangement direction by engaging the parts to be connected of the wires and the grooves 72 corresponding to the connecting members 70 including the restricting portions on the surfaces thereof, i.e. a step of determining positions of the wires 10 with respect to the wire connection surfaces 27*a* of the terminals 20.

Figure 1:
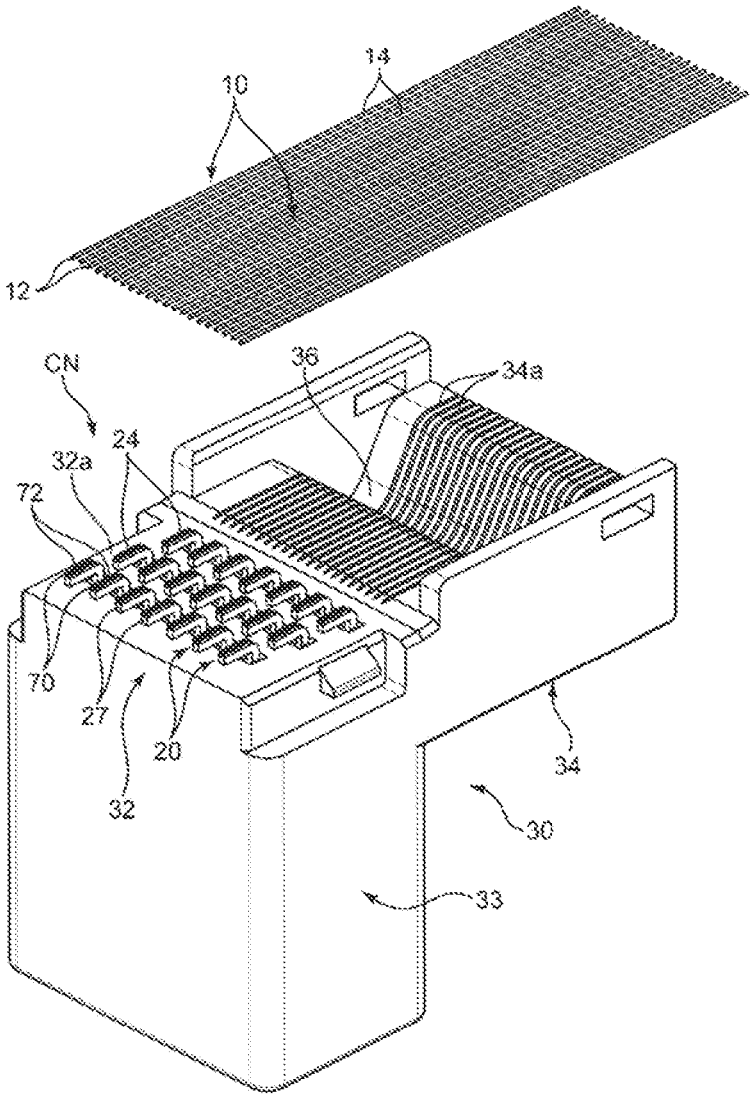
FIG. 1 is an exploded perspective view of an electrical connection assembly according to an embodiment of the present invention.
Figure 2:
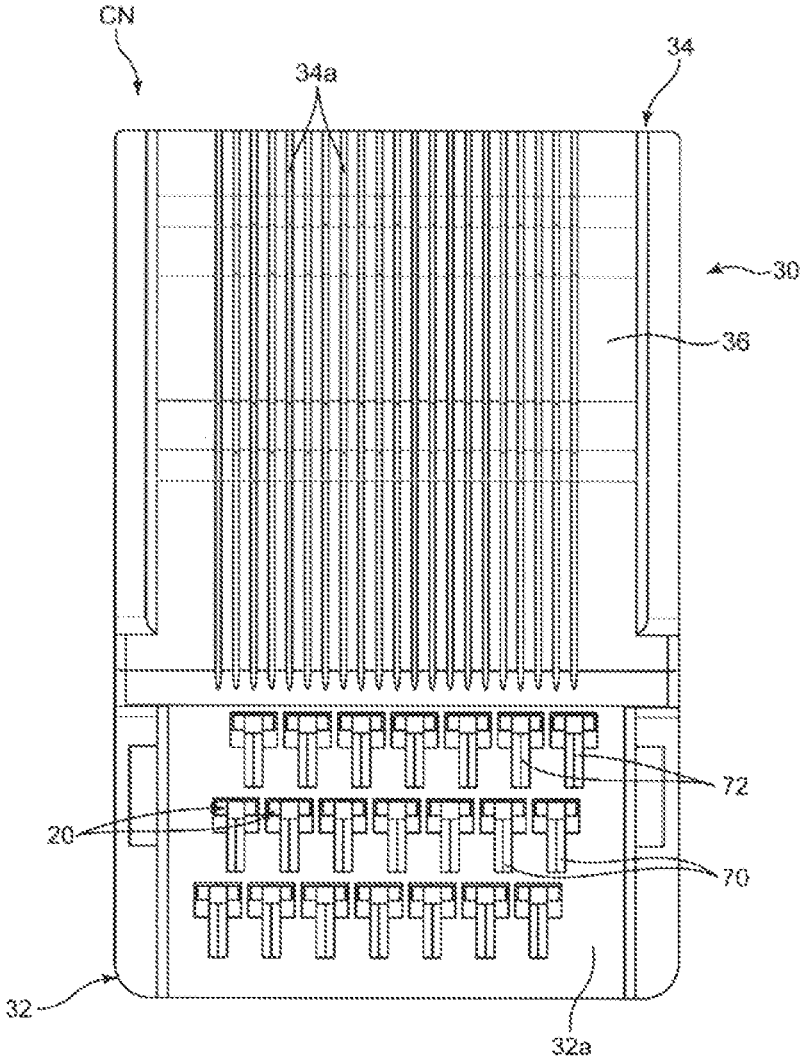
FIG. 2 is a plan view of a connector constituting the electrical connection assembly.
Figure 3:
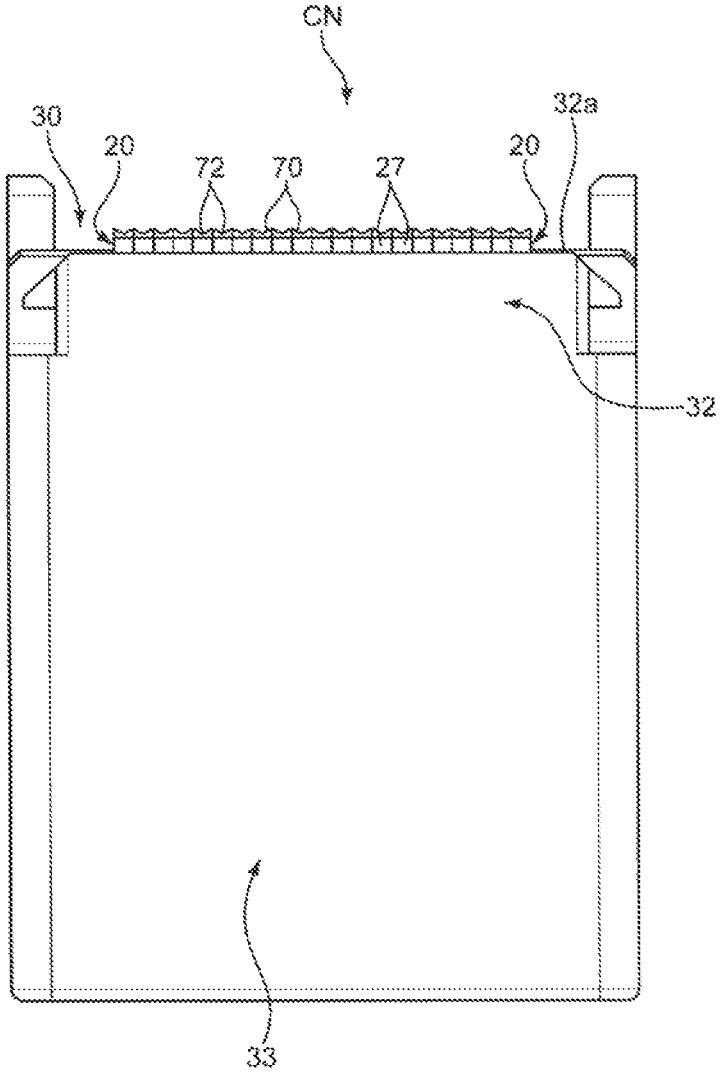
FIG. 3 is a front view of the connector.

The parts in the longitudinally intermediate areas of the wires 10 that are to be connected are fit into the respective grooves 72 with the parts to be connected kept covered by the insulation coatings 14 while a state where the wires 10 are arranged at intervals from each other in the wire arrangement direction is maintained, as shown in FIG. 1.

The wires 10 are held at both outer positions across the parts to be connected, more preferably at positions outward of both ends of the connector CN in a front-rear direction (direction parallel to the second direction and the wire longitudinal direction). The wires 10 preferably are held by being fit into the respective grooves 72 while a suitable tension is applied to each of the wires 10. The wires 10 can be held, for example, using a bobbin on which the wires 10 are to be wound, a clamping tool for clamping the respective wires 10 from both sides in a direction orthogonal to both the longitudinal direction of the wires 10 and the wire arrangement direction, or the like.

Since the groove 72 has the left and right positioning inclined surfaces 73, 74 in this embodiment, the part of each wire 10 to be connected is fit smoothly into the groove 72 by being guided between the positioning inclined surfaces 73, 74. In a state after fitting, the part to be connected is positioned at a proper position (generally a center position in the width direction of the wire connection surface 27*a*, i.e. the wire arrangement direction) on the wire connection surface 27*a*, and is restricted from deviating from this position in the wire arrangement direction. This enhances connection reliability between the wire 10 and the wire connection surface 27*a*. Particularly, since the groove 72 extends in the direction (second direction) parallel to the longitudinal direction of the wire 10, it is possible to position the part to be connected of the wire 10 in the wire arrangement direction, and also to hold the part to be connected in a preferable posture (i.e. posture extending in the second direction).

3-2) Connecting Member Welding Step

This step electrically connects the parts to be connected and the wire connection surfaces 27*a* via the connecting members 70 by heating and melting the solder constituting the connecting members 70 in an engaged state where the parts of the wires 10 that are to be connected are fit in the grooves 72 of the connecting members 70. In this embodiment, a part of the insulation coating 14 of each wire 10 covering the part of the conductor 12 to be connected is heated together with the connecting member 70. Thus, this step simultaneously removes the insulation coating 14 covering the part to be connected from the surface of the conductor 12 by melting or decomposition and electrically connects the conductor 12 exposed by removing the insulation coating 14 and the wire connection surface 27*a* having the connecting member 70 including the groove 72 fixed thereto via the connecting member 70.

Figure 11:
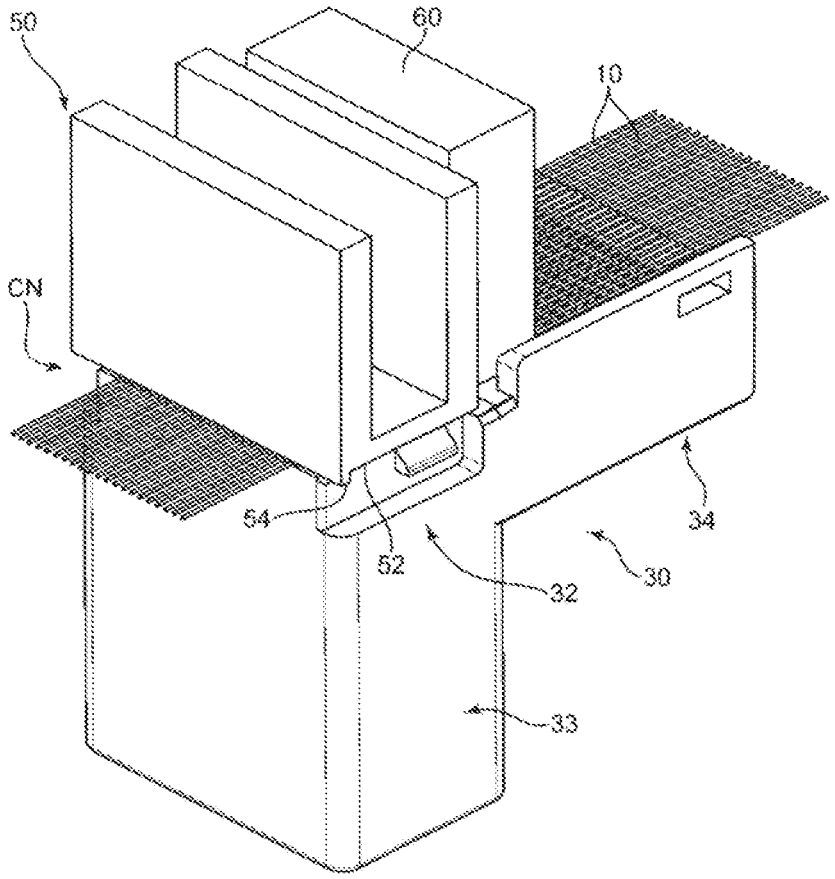
FIG. 11 is a perspective view showing a step of connecting the wire connection surfaces of the respective terminals of the connector and the parts to be connected of the wires in a method for manufacturing the electrical connection assembly.
Figure 12:
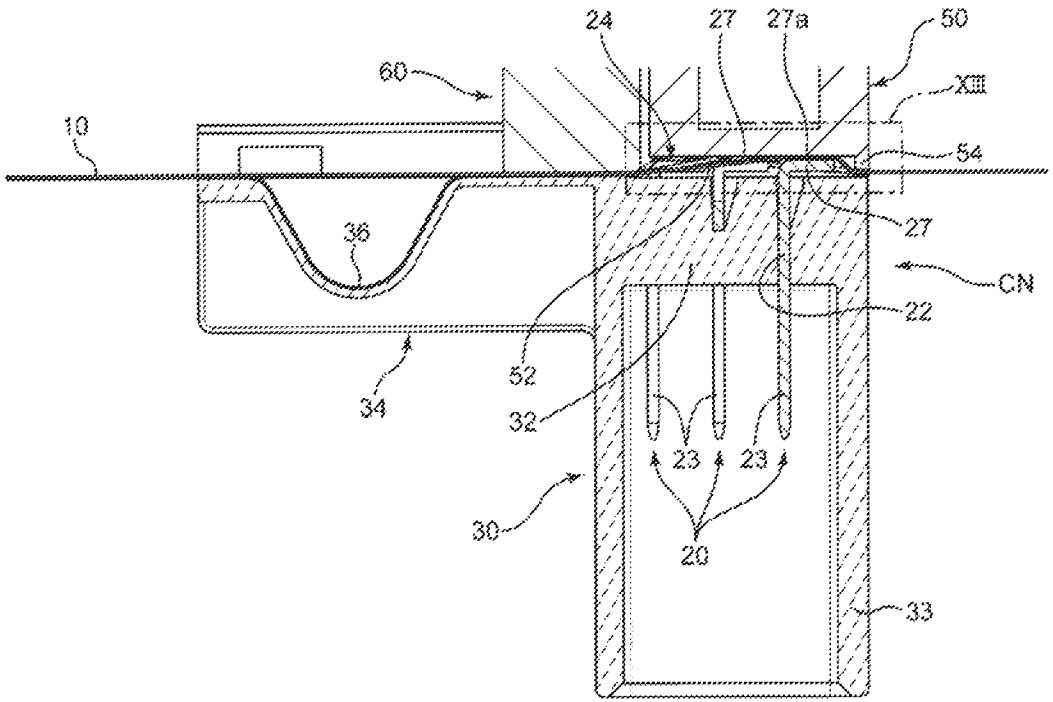
FIG. 12 is a side view in section showing the step shown in FIG. 11.

The wires 10 can be efficiently pressed against the wire connection surfaces 27*a* and heated using a heater 50 shown in FIGS. 11 to 13. This heater 50 has a flat lower surface constituting a heating surface 52. The melting of the connecting members 70 by the heater 52 and the melting or decomposition of the insulation coatings 14 by heating the insulation coatings 14 covering the parts to be connected are performed simultaneously by pressing the heating surface 52 against the wires 10 set on the respective wire connection surfaces 27*a* via the connecting members 70 from above, i.e. by pressing the heating surface 52 toward the wire connection surfaces 27*a* with the parts to be connected and the connecting members 70 corresponding to the wire connection surfaces 27*a* sandwiched between the heating surface 52 and the respective wire connection surfaces 27*a*. The melting or decomposition of the insulation coatings 14 enables the insulation coatings 14 to be removed from the surfaces of the conductors 12.

Figure 14:
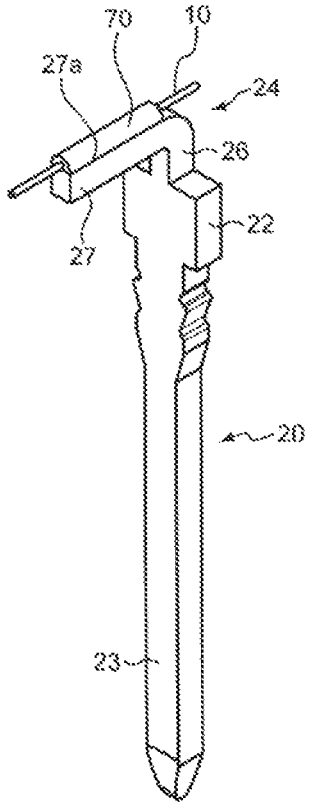
FIG. 14 is a perspective view showing a state where the part to be connected is electrically connected to the wire connection surface via the connecting member by melting the connecting member.
Figure 15:
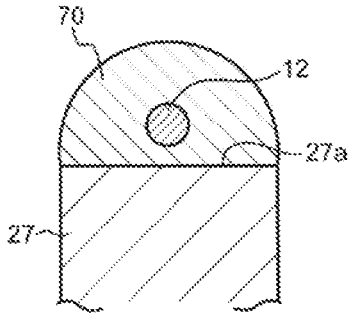
FIG. 15 is a front view in section showing the state of FIG. 14.

The connecting member 70 melted in this way is fixed in such a shape that the part to be connected and the terminal 20 are connected electrically while the connecting member 70 is held in a state directly in contact with the part of the conductor 12 that is to be connected, as shown in FIGS. 14 and 15, by being solidified by natural cooling or forced cooling thereafter. That is, the connecting member 70 functions as a positioning member for positioning the wire 10 with respect to the wire connection surface 27*a* before being heated and as a connecting medium for connecting the wire connection surface 27*a* and the conductor 12 of the wire 10. In addition, a transition from the positioning state to the connecting state can be made efficiently by a simple operation of melting the connecting member 70 by heating.

The terminal holding portion 32 of the insulating housing 30 holds the respective terminals 20 such that the respective wire connection surfaces 27*a* are arranged on the same plane, i.e. the terminals 20 constitute a planar array. Thus, the respective wire connection surfaces 27*a* and the parts of the conductors 12 of the respective wires 10 that are to be connected can be connected satisfactorily and simultaneously by simultaneously and equally heating the plurality of connecting members 70 using the heating surface 52 in the form of a single flat surface.

Further, since each wire connection surface 27*a* is provided on the outer projection 24 projecting out (up in FIG. 13) of the terminal holding portion 32 from the upper surface 32*a* of the terminal holding portion 32 in this embodiment, the connecting step can be performed with the wire 10 deformed into a shape convex outward at the outward projection 24, as shown in FIG. 13, by pressing the wire 10 against the surface of the insulating housing 30 (preferably the upper surface 32*a* of the terminal holding portion 32) at opposite positions across the outward projection 24 of the terminal 20. Specifically, in an example shown in FIGS. 11 to 13, the connecting step is performed by the cooperation of a pressing portion 54 provided on the heater 50 in advance and projecting farther out than the heating surface 52 and a pressing member 60 prepared separately from the heater 50.

4) Cutting Step

After the connecting step is completed as described above, the wires 10 are cut in suitable longitudinal parts. This cutting can be performed efficiently, for example, by sandwiching and shearing the wires 10 at a suitable cutting position in a direction orthogonal to the longitudinal direction of the wires 10 and the wire arrangement direction by a pair of cutting tools. The connector CN according to this embodiment is connected to the ends of the wires 10 and, hence, the wires 10 are cut at positions opposite to the wire holding portion 34 across the terminal holding portion 32 (preferably at a position in immediate vicinity of the outer side surface of the terminal holding portion 32).

After this cutting step, the cover 40, as shown in FIG. 16, is mounted if necessary to complete the electrical connection assembly. Note that the cutting step and the mounting of the cover 40 are not essential in the present invention and can be omitted as appropriate.

The invention is not limited to the embodiment described above. For example, the invention includes the following modes.

A) Concerning Shape of Connecting Members

The specific shape of the recess formed in the connecting member is not limited. This shape may be any shape including the restricting portions for restricting a displacement of the wire in the wire arrangement direction by allowing the wire to fit into the recess. The recess may be, for example, a recessed groove surrounded by a flat bottom wall and two side walls standing from both widthwise ends of the bottom wall, i.e. a recessed groove having a rectangular cross-sectional shape open upward. However, a recessed groove having two positioning inclined surfaces as shown in the embodiment has an advantage of more accurately positioning the wire by the positioning inclined surfaces reliably contacting the outer peripheral surface of the wire.

The surface shape of the connecting member is not limited to the one including the recess into which the conductor of the wire is fit as described above, and may be any convex-concave shape including restricting portions for restricting a relative displacement of the wire in the wire arrangement direction. The restricting portions may be projections formed at a distance from each other in the wire longitudinal direction at both sides of the wire. Alternatively, the restricting portions may include a first wall standing upright on one side of the wire and a second wall standing upward on the other side of the wire at a position displaced from the first wall in the wire longitudinal direction.

Furthermore, the positions of the restricting portions in the width direction of the wire connection surface also are not limited. For example, a wire having a diameter larger than the width of the wire connection surface can be held by causing the connecting member to be plastically deformed such that parts of the connecting member bulge outward of both widthwise ends of the wire connection surface and forming restricting portions in the bulging parts.

B) Concerning Formation of Restricting Portions

The shape of the restricting portions in the connecting member is not limited to the one obtained by the plastic deformation of the solder constituting the connecting member. The restricting portions can also be formed, for example, by a removal processing of the connecting member, preforming by a mold or the juxtaposition of solder pieces on the wire connection surface.

C) Concerning Connection of Wire Connection Surface and Part to be Connected

In the above embodiments, the insulation coating 14 is removed from the surface of the conductor 12 by melting or decomposition simultaneously with the melting of the connecting member 70 by heating with the heater, but the insulation coating 14 may be removed before heating. Specifically, the insulation coating is removed to expose the part to be connected of the conductor set in each of the wires by a stripping process before the connecting step, and the conductor exposed as described above and the wire connection surface may be soldered directly in the connecting step. In this case, a material constituting the insulation coating may not necessarily be meltable or decomposable. It goes without saying that the removal of the insulation coatings is not necessary if the respective wires are bare wires.

As described above, a connector constituting an electrical connection assembly with wires and the connector and a method for manufacturing an electrical connection assembly provided with the same are provided. The connector and the method are capable of ensuring high connection reliability by stabilizing relative positions of the wires and terminals included in the connector effectively utilizing connecting members formed of solder.

The invention claimed is:

1. A connector of an electrical connection assembly including wires, each of the wires having a conductor, and the electrical connection assembly being connected to the wires, the connector comprising:

terminals respectively corresponding to the wires; and connecting members formed of solder and respectively applied to the terminals; and an insulating housing for collectively holding the terminals arranged in a wire arrangement direction such that the wires are conductively connectable to the terminals respectively via the connecting members while being arranged at intervals in the wire arrangement direction orthogonal to a longitudinal direction of the wires;

wherein:

each of the terminals includes an outward projection projecting farther outward than a surface of the insulating housing, the outward projection has a wire connection surface connectable to the conductor of the respective wire at a position separated outward of the insulating housing from the surface of the insulating housing, and the connecting member is fixed on the wire connection surface; and a surface of the connecting member fixed on the wire connection surface of at least some of the plurality of terminals has a convex-concave shape including a concave restricting recess of solder located between two convex portions on both sides of the wire in the wire arrangement direction and the convex portions defining restricting portions configured to receive the wire therein and to restrict a relative displacement of the wire with respect to the wire connection surface in the wire arrangement direction prior to forming a solder connection of the connecting member to the wire.

2. The connector of claim 1, wherein the restricting recess is a groove extending parallel to the longitudinal direction of the wire.

3. The connector of claim 2, wherein the groove includes two positioning inclined surfaces inclined toward each other in a direction parallel to the wire arrangement direction toward a bottom part of the groove as the restricting portions.

4. A method for manufacturing an electrical connection assembly including a plurality of wires each having a conductor, comprising:

a connector preparing step of preparing the connector of claim 1; and a connecting step of electrically connecting a part of each of the wires and the wire connection surface corresponding to this part to be connected with the wires arranged at intervals in the wire arrangement direction;

wherein the connector preparing step includes fixing the connecting member to the wire connection surface of at least some of the terminals, holding the terminals in the insulating housing, and forming the restricting portions on the surface of the connecting member by plastically deforming the connecting member fixed to the wire connection surface; and wherein the connecting step includes determining a relative position of the wire with respect to the wire connection surface having the connecting member fixed thereto by engaging the connecting member and the wire such that a relative displacement of the part of the wire to be connected to the connecting member is restricted by the restricting portions, and electrically connecting the part of the wire to be connected and the wire connection surface via the connecting member by heating and melting the solder constituting the connecting member in the engaged state.

5. The method for manufacturing an electrical connection assembly of claim 4, wherein the restricting portions are formed after the terminals are held in the insulating housing.

* * * * *